US010448789B2

(12) United States Patent
Buckingham

(10) Patent No.: US 10,448,789 B2
(45) Date of Patent: Oct. 22, 2019

(54) FOLDABLE BOTTOM WIPER

(71) Applicant: Christine Buckingham, Milborne St Andrew (GB)

(72) Inventor: Christine Buckingham, Milborne St Andrew (GB)

( * ) Notice: Subject to any disclaimer, the term of this patent is extended or adjusted under 35 U.S.C. 154(b) by 0 days.

(21) Appl. No.: 15/833,724

(22) Filed: Dec. 6, 2017

(65) Prior Publication Data

US 2018/0153357 A1 Jun. 7, 2018

(51) Int. Cl.
*A47K 7/08* (2006.01)
*A47K 10/18* (2006.01)

(52) U.S. Cl.
CPC ..... *A47K 7/08* (2013.01); *A47K 10/18* (2013.01)

(58) Field of Classification Search
CPC ..... A47K 7/08
USPC ..... 4/661
See application file for complete search history.

(56) References Cited

U.S. PATENT DOCUMENTS

2014/0037363 A1 2/2014 Sullivan et al.

FOREIGN PATENT DOCUMENTS

GB 2424173 A 9/2006

*Primary Examiner* — Lori L Baker
(74) *Attorney, Agent, or Firm* — Global Intellectual Property Agency, LLC; Daniel Boudwin

(57) ABSTRACT

A foldable bottom wiper. The foldable bottom wiper includes a wiper head having a paper contact surface extending from a base, and a handle extending from the head. The paper contact surface has a recess into which toilet paper can be tucked. In use, toilet paper can be placed over the contact surface and secured thereto by tucking part of the paper into the recess whereby the papers are secured to the head while paper on the head is wiped over part of a bottom to be cleaned with the contact surface of the head facing generally upwards, and the soiled paper being removed by facing the head generally downwards and allowing the papers to fall off under gravity.

17 Claims, 4 Drawing Sheets

FOLDABLE BOTTOM WIPER

CROSS REFERENCE TO RELATED APPLICATION

This application claims priority from Great Britain Application for Patent No. GB1620781.3 filed Dec. 6, 2016. The above identified patent application is herein incorporated by reference in its entirety to provide continuity of disclosure.

BACKGROUND OF THE INVENTION

Field of the Invention

The present invention relates to a foldable bottom wiper. More specifically, the present invention provides a bottom wiper comprising a wiper head having a paper contact surface extending from a base, and a handle extending from the head, said paper contact surface having a recess into which toilet paper can be tucked, in use toilet paper being placed over the contact surface and secured thereto by tucking part of the paper into the recess whereby the papers is secured to the head whilst paper on the head is wiped over part of a bottom to be cleaned with the contact surface of the head facing generally upwards, and the soiled paper being removed by facing the head generally downwards and allowing the papers to fall off under gravity.

Many people, especially persons having limited hand/arm function, find it difficult to reach and hygienically wipe after toilet use. The proper cleaning of one's anatomical region, particularly the anal and perineal regions of the body, after using the toilet is critical to proper and thorough hygiene.

Devices have been disclosed in the known art that relate to wiping devices. These include devices that have been patented and published in patent application publications. These devices in the known art have several known drawbacks.

In light of the devices disclosed in the known art, it is submitted that the present invention substantially diverges in design elements from the devices in the known art and consequently it is clear that there is a need in the art for an improvement to existing wiping devices. In this regard, the instant invention substantially fulfills these needs.

SUMMARY OF THE INVENTION

In view of the foregoing disadvantages inherent in the known types of bottom wiping devices now present in the art, the present invention provides a new bottom wiping device wherein the same can be utilized for providing convenience for the user when cleaning the perineal regions of the body.

It is therefore an object of the present invention to provide a new and improved bottom wiping device comprising a wiper head having a paper contact surface extending from a base, and a handle extending from the head, said paper contact surface having a recess into which toilet paper can be tucked, in use toilet paper being placed over the contact surface and secured thereto by tucking part of the paper into the recess whereby the papers is secured to the head whilst paper on the head is wiped over part of a bottom to be cleaned with the contact surface of the head facing generally upwards, and the soiled paper being removed by facing the head generally downwards and allowing the papers to fall off under gravity.

It is another object of the present invention to provide one embodiment of the bottom wiping device wherein the handle is hinged to the head whereby the head can be folded away from the handle in use and adjacent the handle when not in use. The handle is formed of two hinged first and second sub-sections which fold from a storage position around the head to an in-use handle position. Preferable the first sub-section is hinged to the second sub-section and the second sub-section is hinged to the head.

Another object of the present invention is to provide at least one releasable catch is provided to hold the wiper in the folded and/or unfolded in use position. The or each catch may be a friction catch. Preferably the or each friction catch forms part of the hinge between the head and the second sub-section and the second sub-section and the first subsection. The hinge may include a static cylindrical section fixed to one part of the wiper forming a cam surface with one or more steps thereon, and a cam follower on the surface of another part of the wiper rotates in one first direction over the step/s around the cylindrical section circumference but the step/s form a friction stop to the cam follower to help prevent rotation in the other second direction. Preferably the cylindrical section is formed of a pair of concentric cylinders connected together by at least one flexible spoke with the outer cylinder forming the cam surface, the outer cylinder being displaceable relative to the inner cylinder to allow the cam follower to ride over the step/s.

Yet another object of the present invention is to provide the bottom wiping device wherein the contact surface is formed of a friction material. The material may be a thermoplastic elastomer.

Yet another object of the present invention is to provide the bottom wiping device wherein the contact surface has an upper face with side walls between the upper face and the base, and the recess opening is formed in the upper face, the recess includes a pair of inwardly directed opposing projections, and a free end of the first sub-section includes a thumb rest.

Another object of the present invention is to provide an embodiment of the foldable bottom wiper comprising a handle is formed of two hinged first and second sub-sections, and a head hinged to the second sub-section, said wiper being foldable fold from a storage position with the sub section around the head to an in use position, and wherein in use the first sub-section extends from the second sub-section at an angle on one side of the second sub-section, and the head in use extends at an angle to an opposing side of the second sub-section, whereby the wiper in use takes a Z-shape in use paper can placed of the head to wipe a bottom to be cleaned. The wiper head has a paper contact surface extending from a base, said paper contact surface having a recess into which toilet paper can be tucked, in use toilet paper being placed over the contact surface and secured thereto by tucking part of the paper into the recess whereby the papers is secured to the head whilst paper on the head is wiped over part of a bottom to be cleaned with the contact surface of the head facing generally upwards, and the soiled paper being removed by facing the head generally downwards and allowing the papers to fall off under gravity. at least one releasable catch is provided to hold the wiper in the folded and/or unfolded in use position. The or each catch may be a friction catch. A friction catch forms part of the hinge between the head and the second sub-section and the second sub-section and the first subsection. The hinge may include a static cylindrical section fixed to one part of the wiper forming a cam surface with one or more steps thereon, and a cam follower on the surface of another part of the wiper rotates in one first direction over the step/s around the cylindrical section circumference but the step/s form a friction stop to the edge to help prevent rotation in the other second direction. Preferably the cylindrical section is formed of a pair of concentric cylinders connected together by at least one flexible spoke with the outer cylinder forming the cam surface, the outer cylinder being displaceable relative to the inner cylinder to allow the cam follower to ride over the step/s.

Another object of the present invention is to provide a foldable bottom wiper that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
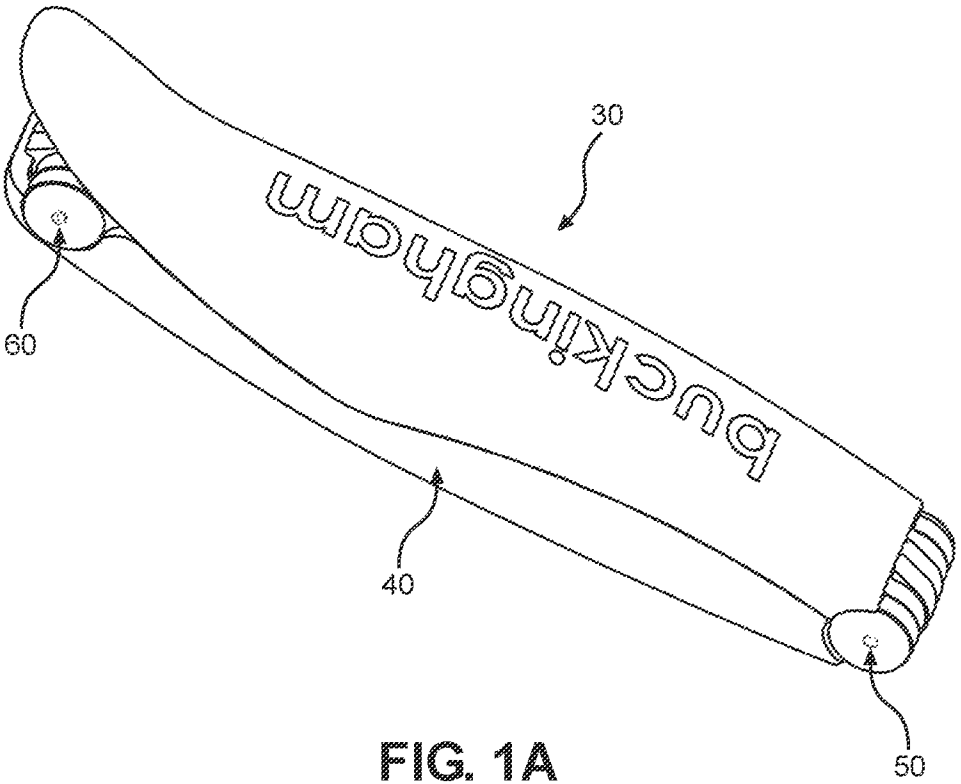
FIG. 1A shows a perspective views of the foldable bottom wiper in the folded position.

Reference is made herein to the attached drawings. Like reference numerals are used throughout the drawings to depict like or similar elements of the foldable bottom wiper. For the purposes of presenting a brief and clear description of the present invention, the preferred embodiment will be discussed as used for wiping a user's bottom. The figures are intended for representative purposes only and should not be considered to be limiting in any respect.

Figure 1B:
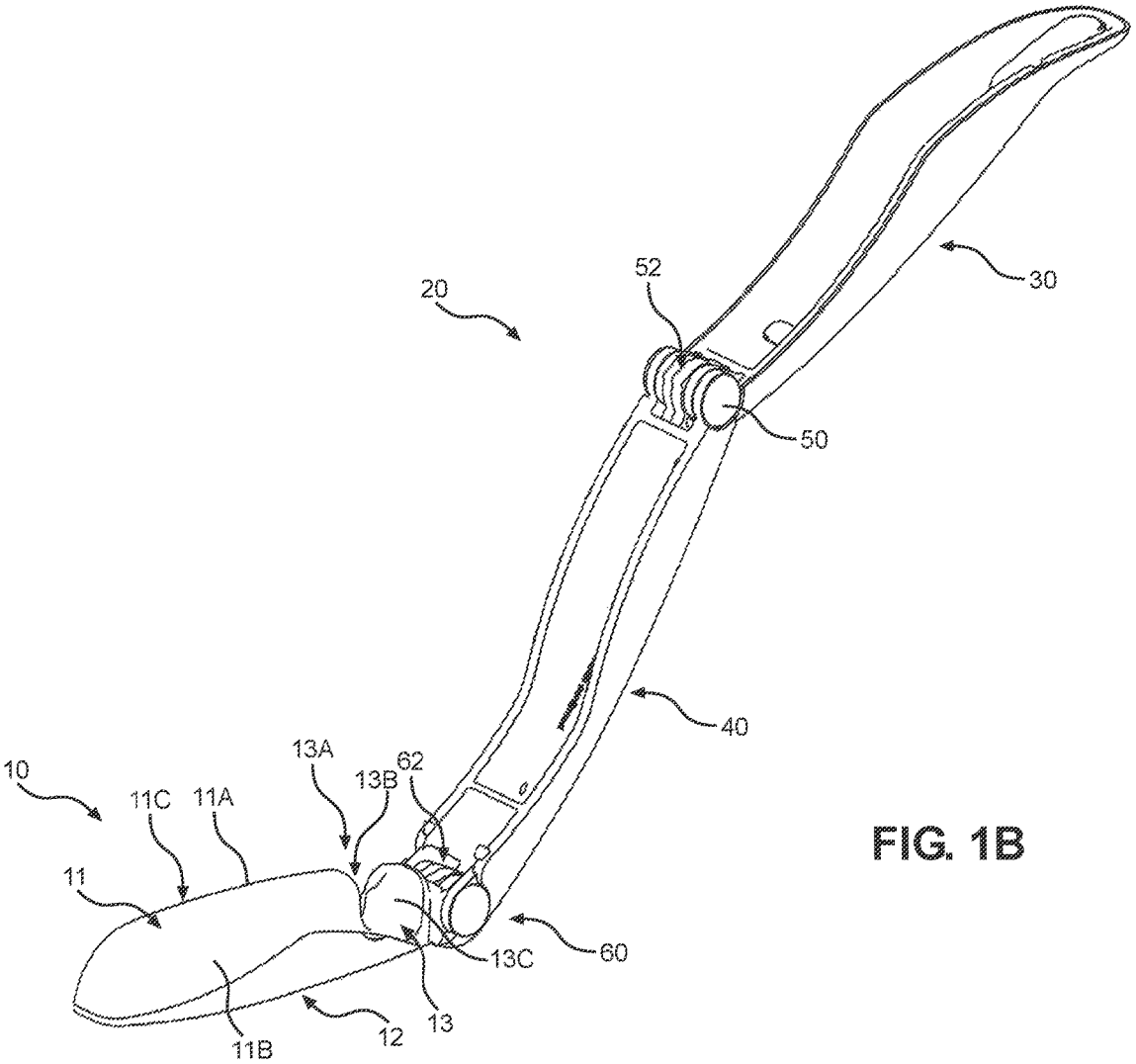
FIG. 1B shows a perspective views of the foldable bottom wiper in the unfolded position.

Referring specifically to FIGS. 1A and 1B, there is shown perspective views of the foldable bottom wiper in the folded position and unfolded position, respectively. Wiper 1 has a wiper head 10 having a curved paper contact surface 11 extending from a base 12. The paper contact surface 11 has a U-shaped recess 13 with an opening 13A into which toilet paper can be tucked. The contact surface 11 is formed of a friction material. The material may be a thermoplastic elastomer which is over-moulded on a plastics base. The contact surface 11 has an upper face 11A with side walls 11B, 11C between the upper face and the base, and the recess 13 opening 13A is formed in the upper face. The recess 13 includes a pair of inwardly directed opposing projections 13B, 13C.

A handle 20 extends from the head 10. Handle 20 is formed from two first and second sub-sections 30, 40 which fold from a storage position around the head (see FIGS. 1A and 2A) with head 10 adjacent subsection 40, to an in-use handle position (see FIGS. 1B and 2B) with head 10 folded away from subsection 40. The first sub-section 30 is hinged to the second sub-section 40 with hinge 50, and the second sub-section 40 is hinged to the head 10 with hinge 60.

In the in-use handle position the first sub-section 30 extends from the second sub-section at an angle (around 140 to 160 degrees, e.g. 150 degrees) on one side of the second sub-section 40, and the head 10 in use extends at an angle (around 110 to 130 degrees. 120 degrees) to an opposing side of the second sub-section 40, whereby the wipe tends towards a Z-shape. Releasable friction catches are provided to hold the wiper in the unfolded in use position and folded position and form part of hinges 50 and 60.

Referring to FIGS. 1A-2B, the hinge 50 has a hinge pin 51 forming the hinge axis which passes through the adjacent ends of first and second sub-sections 30, 40. The hinge 50 includes a static cylindrical section 52 fixed to the end 40A of the second subsection 40 of the wiper. The circumference of section 52 forms a cam surface 53 with two opposing steps 54A, 54B thereon. An end edge 30A of first sub-section 30 forms a cam follower on the cam surface 53 as it rotates away in one first direction from the second sub-section 40 opening the wiper. The edge 30A passes over the steps 54A, 54B around the cylindrical section circumference to the position shown in FIG. 2B. In this position the step 54B forms a friction stop to the edge to help prevent rotation of the first sub-section 30 in the other second direction towards second sub-section 40 closing the wiper. The wiper can be closed by rotating the first sub-section 30 towards second sub-section 40 with extra force to cause the edge 30A to pass over step 54B, and then ride over step 54A as shown in FIG. 2A where step 54A forms a friction stop to the edge 30A to help prevent rotation of the first sub-section 30 back in the first direction away from second sub-section 40 re-opening the wiper.

Preferably the cylindrical section is formed of a pair of concentric cylinders 55A, 55B connected together by at least one flexible spoke 56 with the outer cylinder 55A forming the cam surface, the outer cylinder being displaceable relative to the inner cylinder to allow the cam follower to ride over the steps 54A, 54B.

Figure 2A:
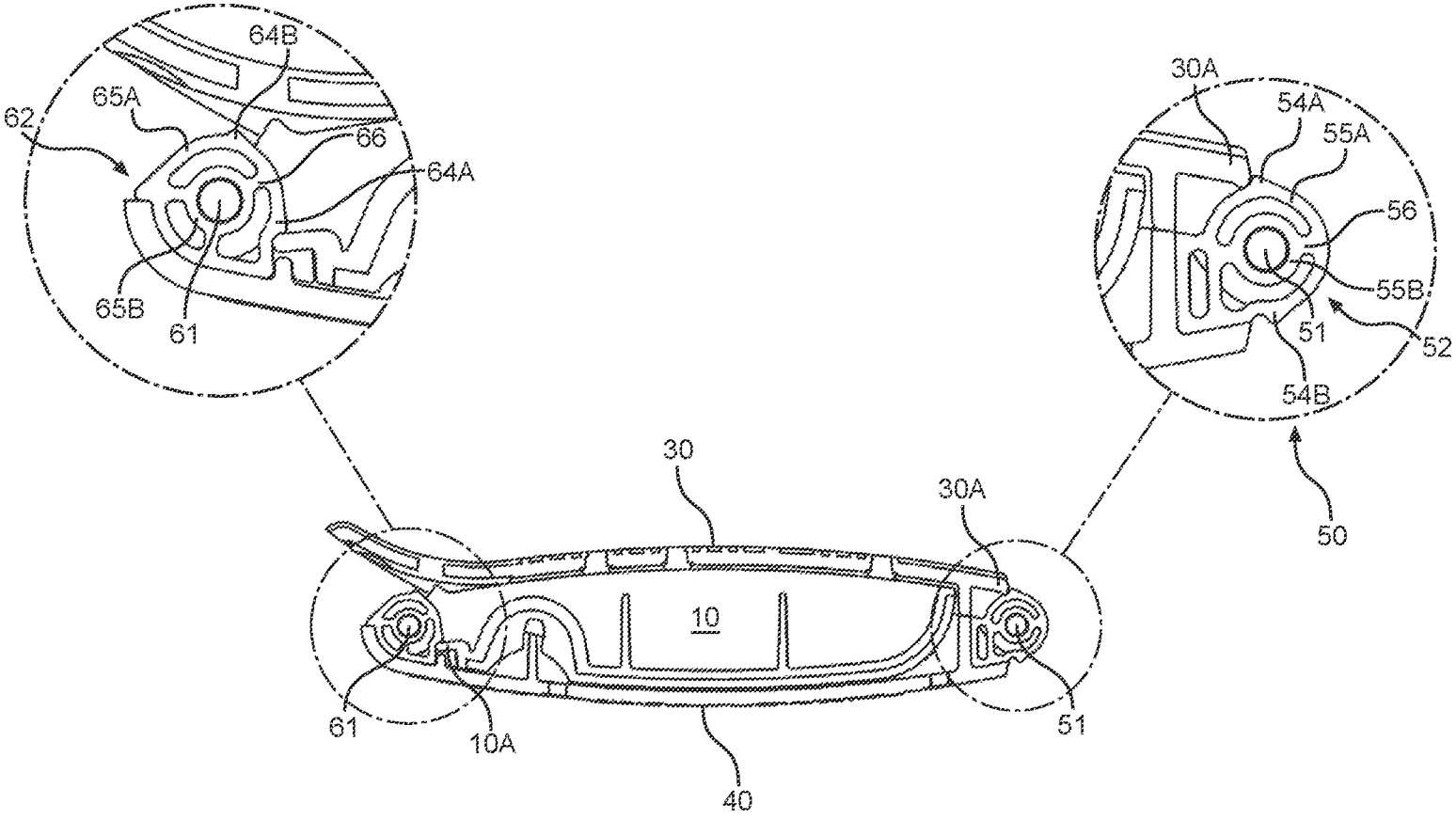
FIG. 2A shows a cross-section views of the foldable bottom wiper in the folded position and close-up views of the hinges.
Figure 2B:
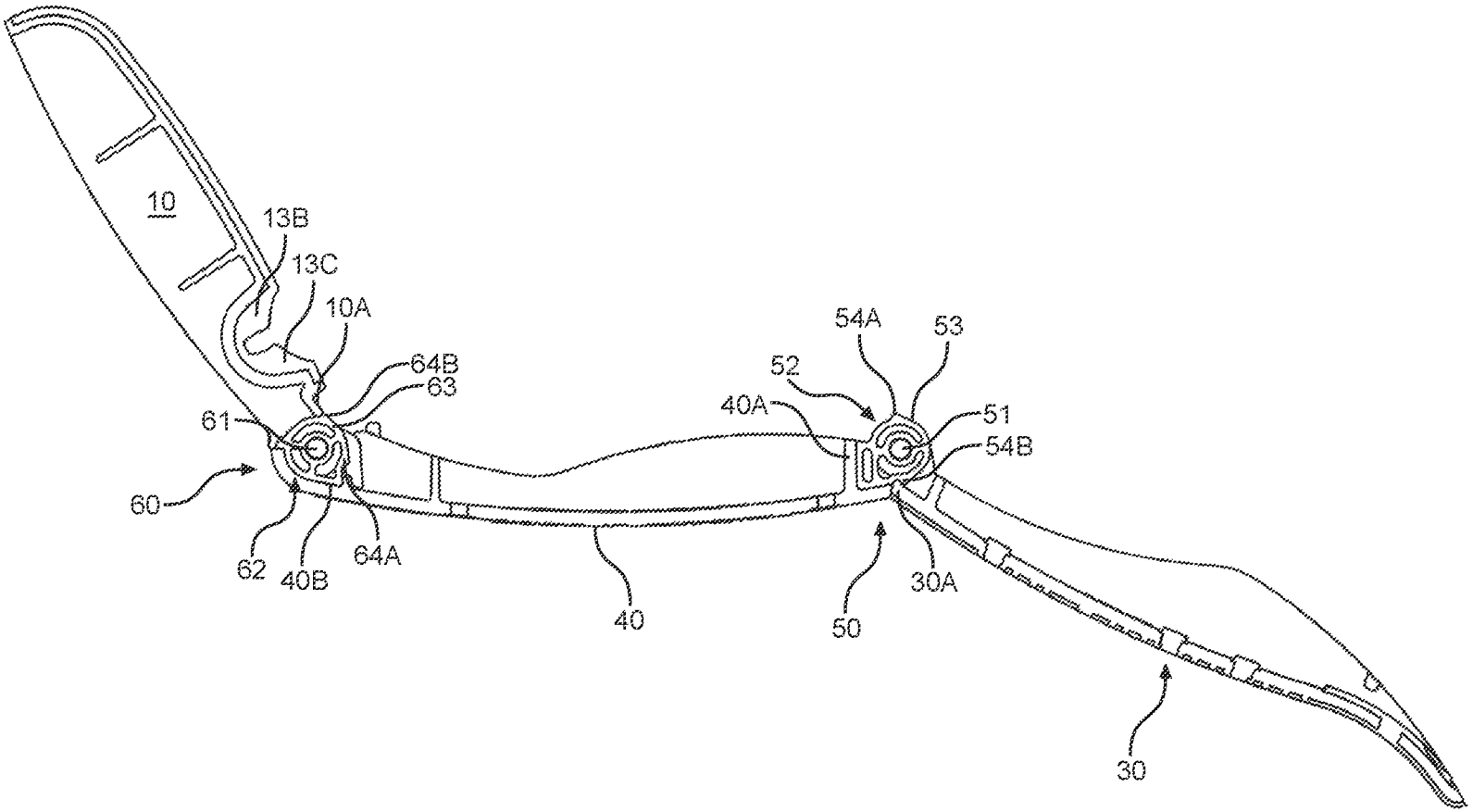
FIG. 2B shows a cross-section view of the foldable bottom wiper in the unfolded position.

Hinge 60 works in an identical way to hinge 50, with a hinge pin 61 forming the hinge axis which passes through the adjacent ends of head 10 and second sub-section 40. The hinge 60 includes a static cylindrical section 62 fixed to the end 40B of the second subsection 40 of the wiper. The circumference of section 62 forms a cam surface 63 with two opposing steps 64A, 64B thereon. An end edge 10A of head 10 forms a cam follower on the cam surface 63 as it rotates away in one first direction from the second sub-section 40 opening the wiper. The edge 10A passes over the steps 64A, 64B around the cylindrical section circumference to the position shown in FIG. 2B. In this position the step 64B forms a friction stop to the edge 10A to help prevent rotation of the head 10 in the other second direction towards second sub-section 40 closing the wiper. The wiper can be closed by rotating the head 10 towards second sub-section 40 with extra force to cause the edge 10A to pass over step 64B, and then ride over step 64A as shown in FIG. 2A where step 64A forms a friction stop to the edge 10A to help prevent rotation of the head 10 back in the first direction away from second sub-section 40 re-opening the wiper.

Again the cylindrical section may form of a pair of concentric cylinders 65A, 65B connected together by at least one flexible spoke 66 with the outer cylinder 65A forming the cam surface, the outer cylinder being displaceable relative to the inner cylinder to allow the cam follower to ride over the steps 64A, 64B. The free end 31 of the first sub-section 30 is shaped so that is provides a thumb rest.

In use, with the wiper in the unfolded position, toilet paper is placed over the contact surface and secured thereto by tucking part of the paper into the recess whereby the papers are secured to the head whilst paper on the head is wiped over part of a bottom to be cleaned with the contact surface of the head facing generally upwards. The soiled paper can be removed by facing the head generally downwards and allowing the papers to fall off under gravity, e.g. into a toilet pan.

The wiper of the invention is designed to fit in a pocket when folded. Air holes may be provided body of the second sub-section 40 to allow the contact surface to be exposed to ambient air.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foldable bottom wiper, comprising:

a wiper head having a paper contact surface extending from a base;

a handle extending from the head;

the handle having a first sub-section and a second sub-section, wherein the first section and the second section are hingedly connected together, wherein the handle is configured to take a Z-shape when in an open position;

the handle is configured to allow the wiper head to fold within the handle when in a storage position;

the paper contact surface having a recess into which toilet paper can be tucked removably securing the paper thereto.

2. The foldable bottom wiper of claim 1, wherein the handle is hingedly attached to the wiper head.

3. The foldable bottom wiper of claim 1, wherein the paper contact surface is formed of a friction material.

4. The foldable bottom wiper of claim 3, wherein the friction material, is a thermoplastic elastomer.

5. The foldable bottom wiper of claim 1, wherein the contact surface has an upper face, and side walls between the upper face and a base, wherein the recess opening is formed in the upper face.

6. The foldable bottom wiper of claim 1, wherein the recess includes a pair of inwardly directed opposing projections.

7. The foldable bottom wiper of claim 1, wherein the hinges further comprise a release catch.

8. The foldable bottom wiper of claim 7, wherein the hinge further comprises a static cylindrical section fixed to one part of the wiper forming a cam surface with one or more steps thereon;

a cam follower on the surface of a second part of the wiper head, wherein the cam follower rotates in one first direction over the one or more steps around the cylindrical section circumference;

the one or more steps forming a friction stop to the cam follower to inhibit rotation in a second direction.

9. The foldable bottom wiper of claim 8, wherein the cylindrical section is formed of a pair of concentric cylinders connected together by at least one flexible spoke with the outer cylinder forming the cam surface;

the outer cylinder being displaceable relative to the inner cylinder to allow the cam follower to ride over the one or more steps.

10. The foldable bottom wiper of claim 7, wherein the release catch is a friction catch.

11. A foldable bottom wiper, comprising:

a wiper head having a paper contact surface extending from a base;

a handle extending from the wiper head;

the handle having a first sub-section and a second sub-section, wherein the first section and the second section are hingedly connected together wherein the hinge contains a release catch;

wherein the hinge further comprises a static cylindrical section fixed to one part of the wiper forming a cam surface with one or more steps thereon;

a cam follower on the surface of a second part of the wiper rotates in one first direction over the one or more step around the cylindrical section circumference;

the one or more step forms a friction stop to the cam follower to inhibit rotation in a second direction the handle is configured to allow the wiper head to fold within the handle when in a storage position;

the paper contact surface having a recess into which toilet paper can be tucked removably securing the paper thereto.

12. The foldable bottom wiper of claim 11, wherein the cylindrical section is formed of a pair of concentric cylinders connected together by at least one flexible spoke with the outer cylinder forming the cam surface;

the outer cylinder being displaceable relative to the inner cylinder to allow the cam follower to ride over the steps.

13. The foldable bottom wiper of claim 11, wherein the paper contact surface is formed of a friction material.

14. The foldable bottom wiper of claim 13, wherein the friction material, is thermoplastic elastomer.

15. The foldable bottom wiper of claim 11, wherein the contact surface has an upper face and side walls between the upper face and a base, wherein the recess opening is formed in the upper face.

16. The foldable bottom wiper of claim 11, wherein the recess includes a pair of inwardly directed opposing projections.

17. A foldable bottom wiper, comprising:

a handle having a first sub-section and a second sub-section hingedly attached together;

a wiper head hingedly attached to the second sub-section, wherein the first sub-section and the second sub-section from a storage position around the head in a storage position; the first sub-section extends from the second sub-section at an angle on one side of the second sub-section, and the head extends at an angle to an opposing side of the second sub-section, wherein the wiper takes a Z-shape; paper rests on the wiper head.

* * * * *